US011054118B2

(12) United States Patent
Sherman

(10) Patent No.: US 11,054,118 B2
(45) Date of Patent: Jul. 6, 2021

(54) APPARATUS TO DETACHABLY ATTACH LED LIGHT FIXTURE TO CEILING OR RECESSED LIGHTING FIXTURE HOUSING

(71) Applicant: David Sherman, Boca Raton, FL (US)

(72) Inventor: David Sherman, Boca Raton, FL (US)

( * ) Notice: Subject to any disclaimer, the term of this patent is extended or adjusted under 35 U.S.C. 154(b) by 0 days.

(21) Appl. No.: 16/392,731

(22) Filed: Apr. 24, 2019

(65) Prior Publication Data

US 2021/0140610 A1 May 13, 2021

(51) Int. Cl.

| | |
|---|---|
| ***F21V 21/04*** | (2006.01) |
| ***F21V 17/12*** | (2006.01) |
| ***F21V 21/088*** | (2006.01) |
| *F21Y 115/10* | (2016.01) |

(52) U.S. Cl.

CPC ..... *F21V 17/12* (2013.01); *F21V 21/04* (2013.01); *F21V 21/088* (2013.01); *F21Y 2115/10* (2016.08)

(58) Field of Classification Search

CPC ..... F21V 21/04; F21V 21/044; F21V 21/047; F21V 21/088; F21V 17/162

USPC ..... 362/147

See application file for complete search history.

(56) References Cited

U.S. PATENT DOCUMENTS 5,957,572 A * 9/1999 Wedekind ..... F21V 21/04 362/365
7,909,487 B1 * 3/2011 Venetucci ..... F21S 8/02 362/147
8,894,253 B2 * 11/2014 Rowlette, Jr. ..... F21V 29/004 362/373
10,393,359 B1 * 8/2019 Qi ..... F21V 21/044
2009/0097262 A1 * 4/2009 Zhang ..... F21S 8/026 362/364
2009/0273938 A1 * 11/2009 Wronski ..... F21S 8/02 362/346
2010/0053950 A1 * 3/2010 Higuchi ..... F21S 8/026 362/234
2012/0044704 A1 * 2/2012 Wilson ..... F21S 8/026 362/365
2012/0182744 A1 * 7/2012 Santiago ..... F21S 8/026 362/365
2014/0254177 A1 * 9/2014 Danesh ..... F21V 21/30 362/363
2015/0233537 A1 * 8/2015 Athalye ..... F21V 7/0066 362/147
2015/0260383 A1 * 9/2015 Wilcox ..... F21S 8/026 362/294
2015/0338071 A1 * 11/2015 Feit ..... F21S 8/036 362/370

(Continued)

*Primary Examiner* — Christopher M Raabe

(57) ABSTRACT

Disclosed is an apparatus to detachably attach an LED light fixture to a ceiling or a recessed lighting fixture housing. The apparatus comprises retrofit clips (102), a plurality of new construction clips (104), connecting posts (106), metal housing (108), screw holes (110), complete fixture (112), junction box (116), and twist connector (118). The retrofit clips (102) are adaptable to attach with the metal housing (108) of the LED light fixture by screwing them into screw holes (110). The connecting posts (106) hold the new construction clips (104). The metal housing (108) embodies the complete fixture (112). The junction box (116) holds connection wirings and may hold an LED driver. The twist connector (118) attaches the output wires of the junction box (116) to the metal housing (108).

5 Claims, 5 Drawing Sheets

(56) References Cited

U.S. PATENT DOCUMENTS

| | | | | |
|---|---|---|---|---|
| 2017/0059102 | A1* | 3/2017 | Grant | F21S 8/026 |
| 2018/0266635 | A1* | 9/2018 | Dong | F21S 8/026 |
| 2018/0313524 | A1* | 11/2018 | Vidal | F21V 23/009 |

* cited by examiner

APPARATUS TO DETACHABLY ATTACH LED LIGHT FIXTURE TO CEILING OR RECESSED LIGHTING FIXTURE HOUSING

TECHNICAL FIELD

The present invention is generally related to an apparatus to detachably attach an LED light fixture to at least one of a ceiling, and a recessed lighting fixture housing.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in-and-of-themselves may also be inventions.

Typically, the consumers and/or electricians have to buy different LED recessed light fixtures for new construction installations and retrofit installations. Currently, various mounting clips are used either for retrofit or new construction applications. This specification recognizes the problems faced by the consumers and/or electricians while installing the LED recessed light fixtures. Additionally, it is recognized in this specification that an apparatus for retrofit and new construction applications can reduce the amount of inventory carried by lighting distributors.

Thus, in view of the above, there is a long-felt need in the industry to address the aforementioned deficiencies and inadequacies.

Further limitations and disadvantages of conventional and traditional approaches will become apparent to one of skill in the art through comparison of described systems with some aspects of the present disclosure, as set forth in the remainder of the present application and with reference to the drawings.

SUMMARY OF THE INVENTION

An apparatus to detachably attach an LED light fixture to at least one of a ceiling and a recessed lighting fixture housing is provided substantially, as shown in and/or described in connection with at least one of the figures, as set forth more completely in the claims.

The apparatus comprises a plurality of retrofit clips (102), a plurality of new construction clips (104), a plurality of connecting posts (106), a metal housing (108), a plurality of screw holes (110), a complete fixture (112), a socket adapter (114), a junction box (116), and a twist connector (118). The plurality of retrofit clips (102) are adaptable to attach with the body of the LED light fixture by screwing them into a plurality of screw holes (110). The plurality of connecting posts (106) hold the new construction clips (104). The metal housing (108) embodies the complete fixture (112). The junction box (116) holds the plurality of connection wirings. The junction box (116) comprises a plurality of output wires. The twist connector (118) attaches the output wires of the junction box (116) to the metal housing (108). The socket adapter (114) replaces a light bulb in the recessed lighting fixture housing.

In an aspect, the new construction clips (104) squeeze ceiling material placed between the new construction clips (104) and an extremity of the metal housing (108).

In an aspect, the complete fixture (112) comprises a plurality of electrical systems, clips, and accessories.

In an aspect, the junction box (116) allows an LED driver to be installed and includes a predefined area to attach a plurality of wires.

Accordingly, one advantage of the present system and method is that it provides both a retrofit application and a new construction application embodied in the same LED light fixture.

Accordingly, one advantage of the present invention is that it allows lighting retailers and distributors to carry only one set of inventory, thus saving money and warehouse space.

These features and advantages of the present disclosure may be appreciated by reviewing the following description of the present disclosure, along with the accompanying figures wherein like reference numerals refer to like parts.

BRIEF DESCRIPTION OF DRAWINGS

The accompanying drawings illustrate the embodiments of apparatus, methods, and other aspects of the disclosure. Any person with ordinary skills in the art will appreciate that the illustrated element boundaries (e.g., boxes, groups of boxes, or other shapes) in the figures represent an example of the boundaries. In some examples, one element may be designed as multiple elements, or multiple elements may be designed as one element. In some examples, an element shown as an internal component of one element may be implemented as an external component in another and vice versa. Furthermore, the elements may not be drawn to scale.

Various embodiments will hereinafter be described in accordance with the appended drawings, which are provided to illustrate, not limit, the scope, wherein similar designations denote similar elements, and in which.

DETAILED DESCRIPTION

Figure 1:
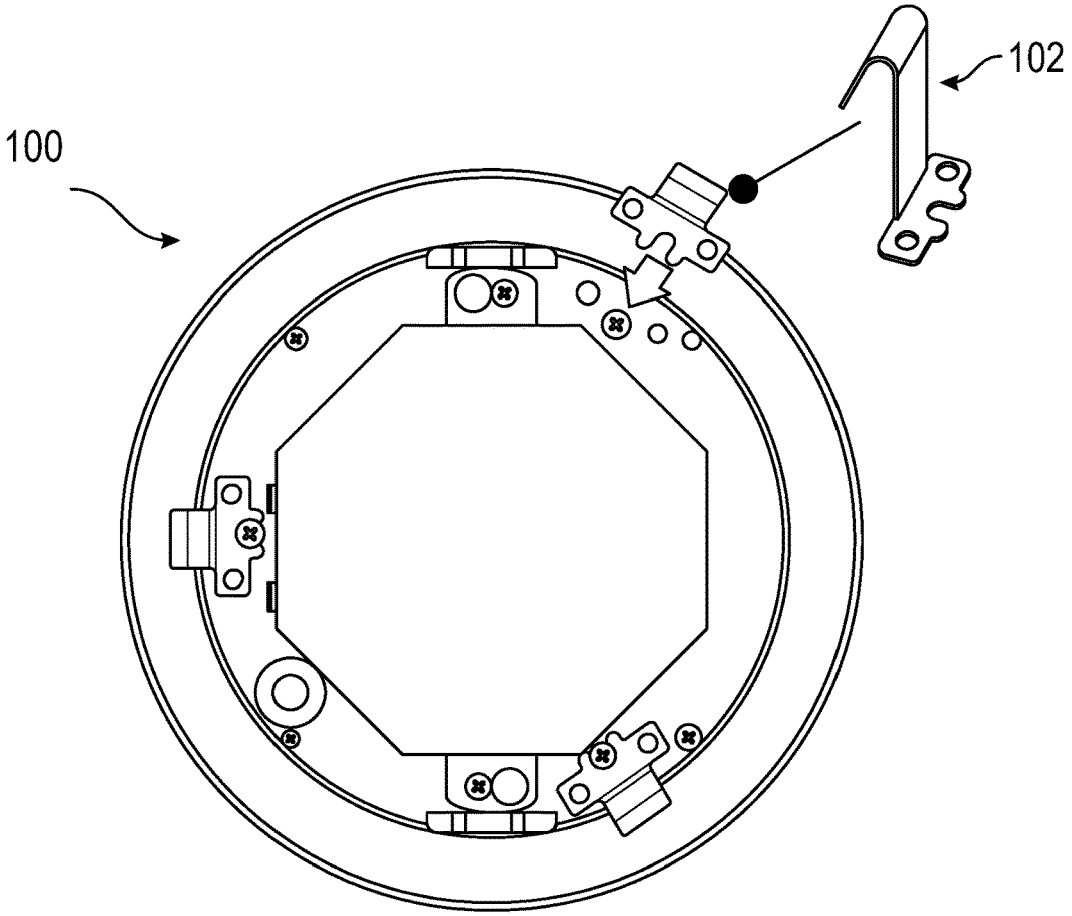
FIG. 1 illustrates an exemplary view of retrofit clips and new construction clips, in accordance with at least one embodiment.

The present disclosure is best understood with reference to the detailed figures and description set forth herein. Various embodiments have been discussed with reference to the figures. However, those skilled in the art will readily appreciate that the detailed descriptions provided herein with respect to the figures are merely for explanatory purposes, as the methods and systems may extend beyond the described embodiments. For instance, the teachings presented, and the needs of a particular application may yield multiple alternative and suitable approaches to implement the functionality of any detail described herein. Therefore, any approach may extend beyond certain implementation choices in the following embodiments.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment.

Methods of the present invention may be implemented by performing or completing manually, automatically, or a combination thereof, selected steps or tasks. The term "method" refers to manners, means, techniques and procedures for accomplishing a given task including, but not limited to, those manners, means, techniques, and procedures either known to, or readily developed from known manners, means, techniques and procedures by practitioners of the art to which the invention belongs. The descriptions, examples, methods, and materials presented in the claims and the specification are not to be construed as limiting but rather as illustrative only. Those skilled in the art will envision many other possible variations within the scope of the technology described herein.

The present specification describes an apparatus to detachably attach an LED light fixture to at least one of a ceiling and a recessed lighting fixture housing. The apparatus comprises a plurality of retrofit clips (102), a plurality of new construction clips (104), a plurality of connecting posts (106), a metal housing (108), a plurality of screw holes (110), a complete fixture (112), a socket adapter (114), a junction box (116), and a twist connector (118).

FIG. 1 illustrates an exemplary view (100) of retrofit clips (102) and new construction clips (104), in accordance with at least one embodiment. The plurality of retrofit clips (102) are adaptable to attach with the body of the LED light fixture by screwing them into a plurality of screw holes (110), shown in FIG. 3.

Figure 2A:
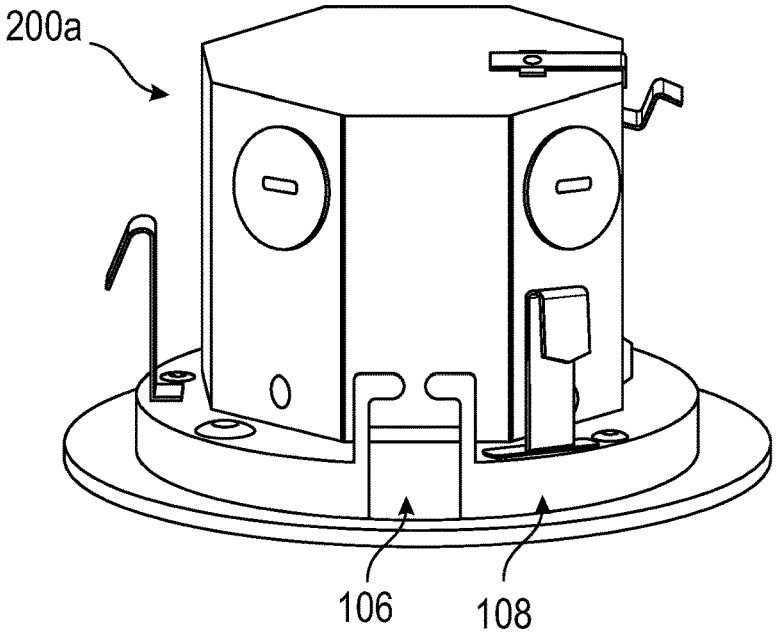
FIG. 2*a* illustrates an exemplary view of connecting post and metal housing, in accordance with at least one embodiment.
Figure 2B:
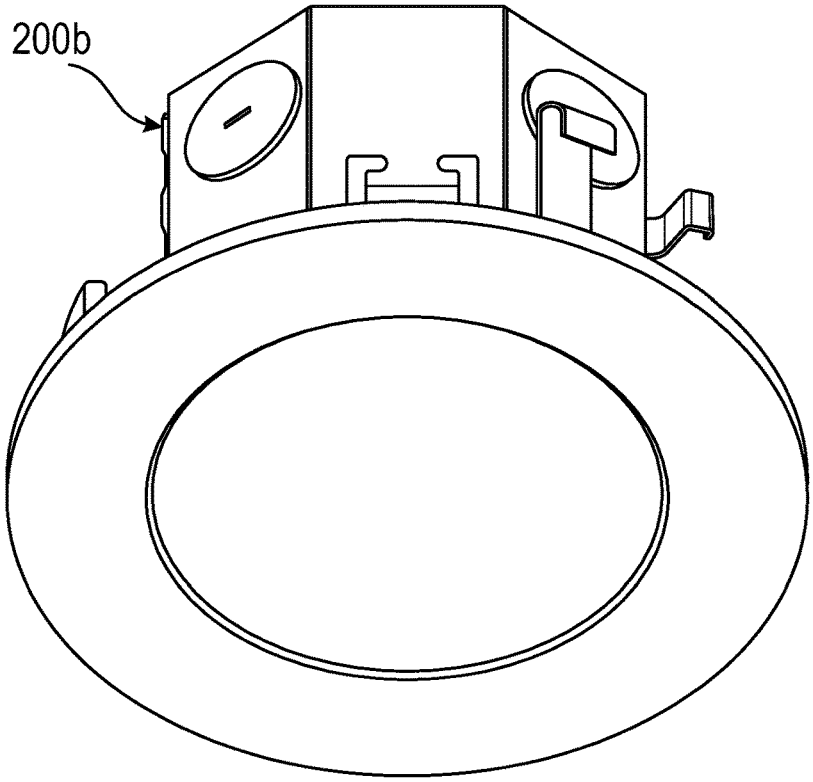
FIG. 2*b* illustrates an exemplary view of the metal housing, in accordance with at least one embodiment.

FIG. 2*a* illustrates an exemplary view (200*a*) of connecting post (106) and metal housing (108), in accordance with at least one embodiment. The plurality of connecting posts (106) hold the new construction clips (104). The metal housing (108) embodies a complete fixture (112), shown in FIG. 6. FIG. 2*b* illustrates an exemplary view (200*b*) of metal housing (108), in accordance with at least one embodiment.

Figure 3:
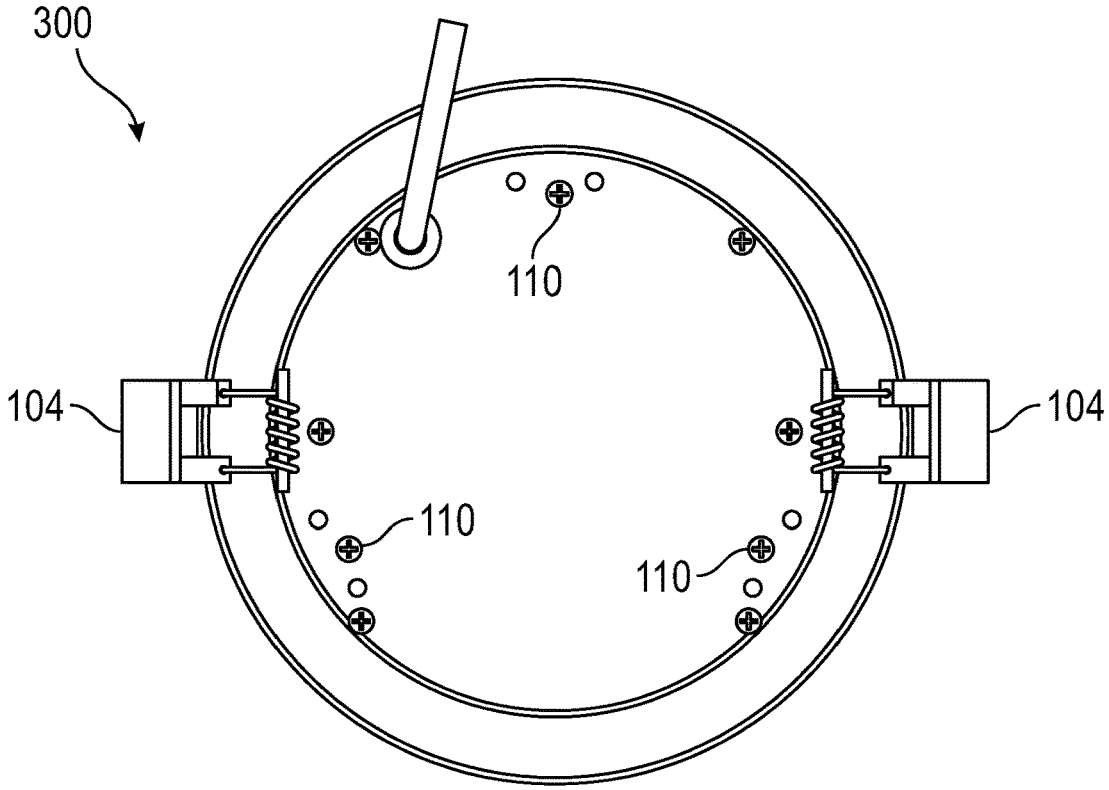
FIG. 3 illustrates an exemplary view of new construction clips and screw holes, in accordance with at least one embodiment.
Figure 4:
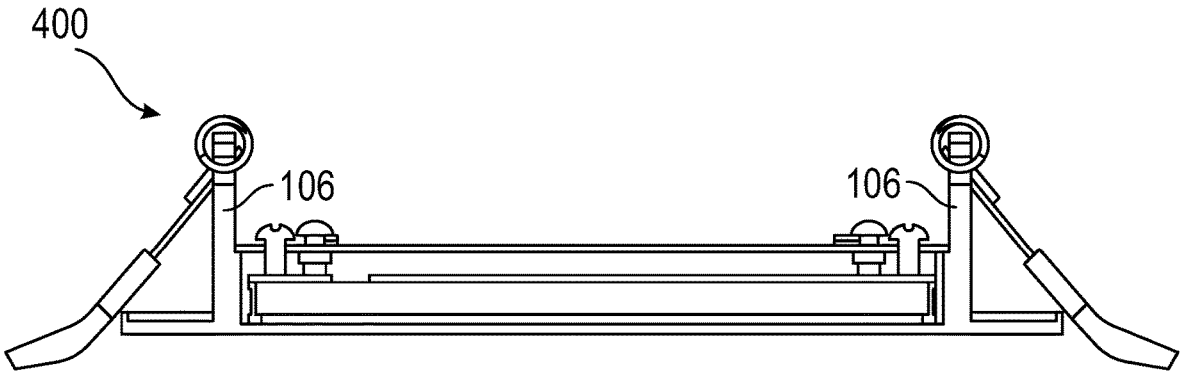
FIG. 4 illustrates an exemplary view of connecting post, in accordance with at least one embodiment.

FIG. 3 illustrates an exemplary view (300) of new construction clips (104) and screw holes (110), in accordance with at least one embodiment. FIG. 4 illustrates an exemplary view (400) of the connecting post (106), in accordance with at least one embodiment.

Figure 5:
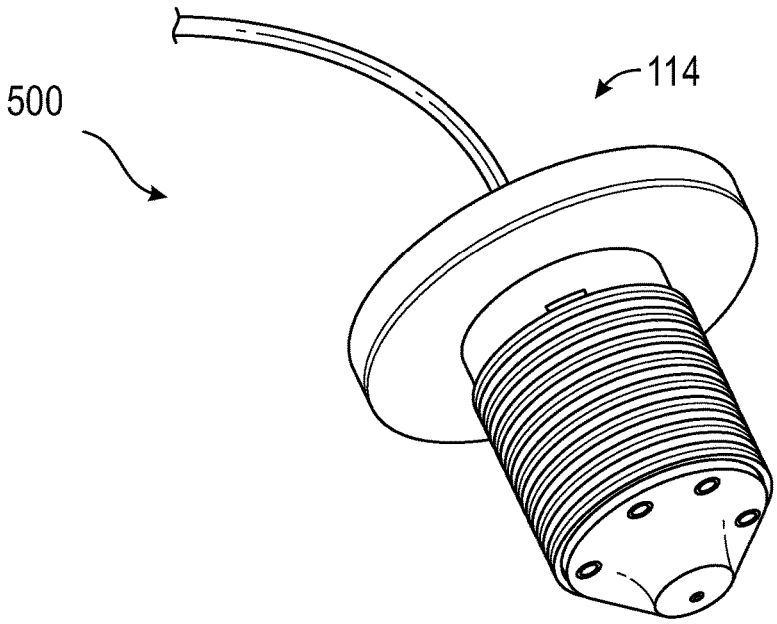
FIG. 5 illustrates an exemplary view of the socket adapter, in accordance with at least one embodiment.

FIG. 5 illustrates an exemplary view (500) of socket adapter (114), in accordance with at least one embodiment. The socket adapter (114) replaces a light bulb in the recessed lighting fixture housing.

Figure 6:
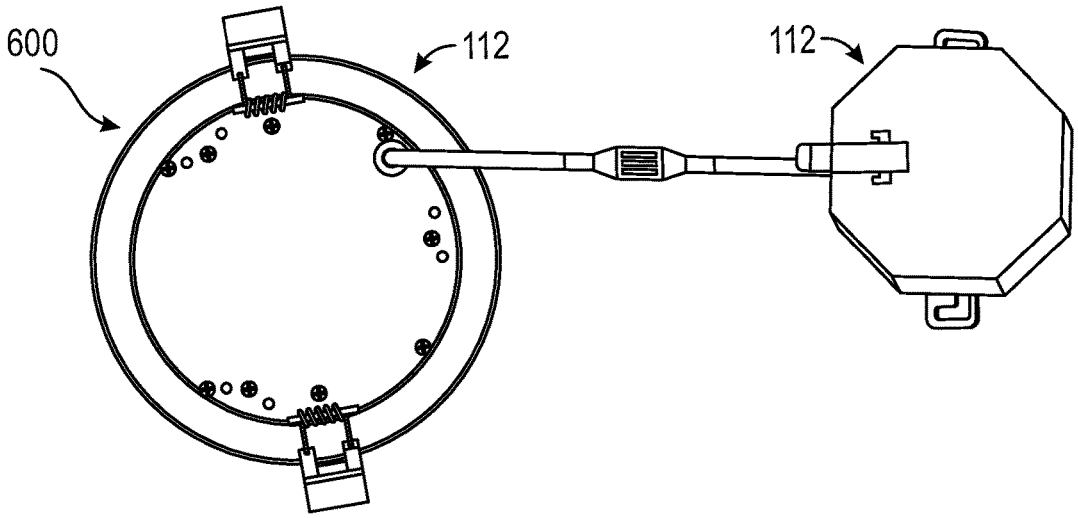
FIG. 6 illustrates an exemplary view of the complete fixture, in accordance with at least one embodiment.

FIG. 6 illustrates an exemplary view (600) of a complete fixture (112), in accordance with at least one embodiment. In an embodiment, the new construction clips (104) squeeze ceiling material placed between the new construction clips (104) and an extremity of the metal housing (108). In an embodiment, the complete fixture (112) comprises a plurality of electrical systems, clips, and accessories. Examples of the electrical systems include but not limited to the LED driver, an LED PCB assembly, and an LED strip. Further, examples of the accessories include but not limited to wire connectors, and ground wire.

Figure 7:
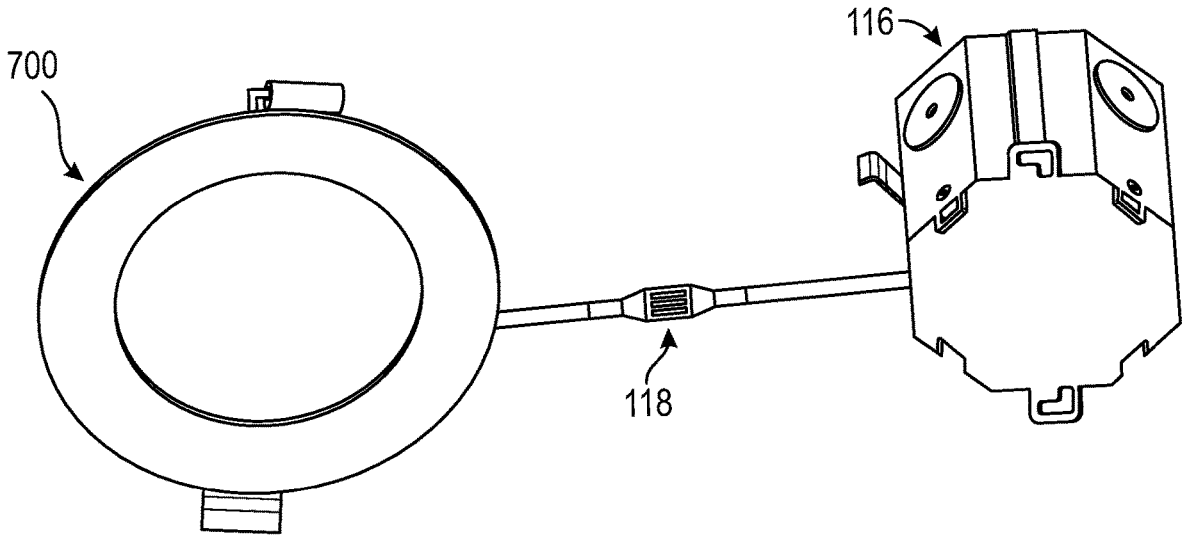
FIG. 7 illustrates an exemplary view of the junction box and twist connector, in accordance with at least one embodiment.

FIG. 7 illustrates an exemplary view (700) of the junction box (116) and twist connector (118), in accordance with at least one embodiment. The junction box (116) holds a plurality of connection wirings. The junction box (116) comprises a plurality of output wires. The twist connector (118) attaches the output wires of the junction box (116) to the metal housing (108). In an embodiment, the junction box (116) allows an LED driver to be installed and includes a predefined area to attach a plurality of wires.

In operation, if the existing recessed housing is present, the retrofit clips (102) make a friction fit inside the existing recessed lighting fixture housing to secure the complete fixture (112) inside. In case, the existing recessed housing is not present the new construction clips (104) are attached to the connecting posts (106).

In an embodiment, the present apparatus may be manufactured by die casting a metal housing (108). The metal housing (108) is a base of the complete fixture (112) containing two connecting posts (106), to attach new construction clips (104) and nine screw holes (110) (each retrofit clips uses 3 screws), at 120 degrees, to accept the retrofit clip (102). In an embodiment, the junction box (116) is made from sheet metal, stamped steel or plastic, configured into a hexagonal, or a round shape, including several side holes to be used for wiring. Further, the LED driver may installed inside the junction box (116). In an exemplary embodiment, the present apparatus may be manufactured by plastic injection molding to obtain a plastic housing.

Figure 8A:
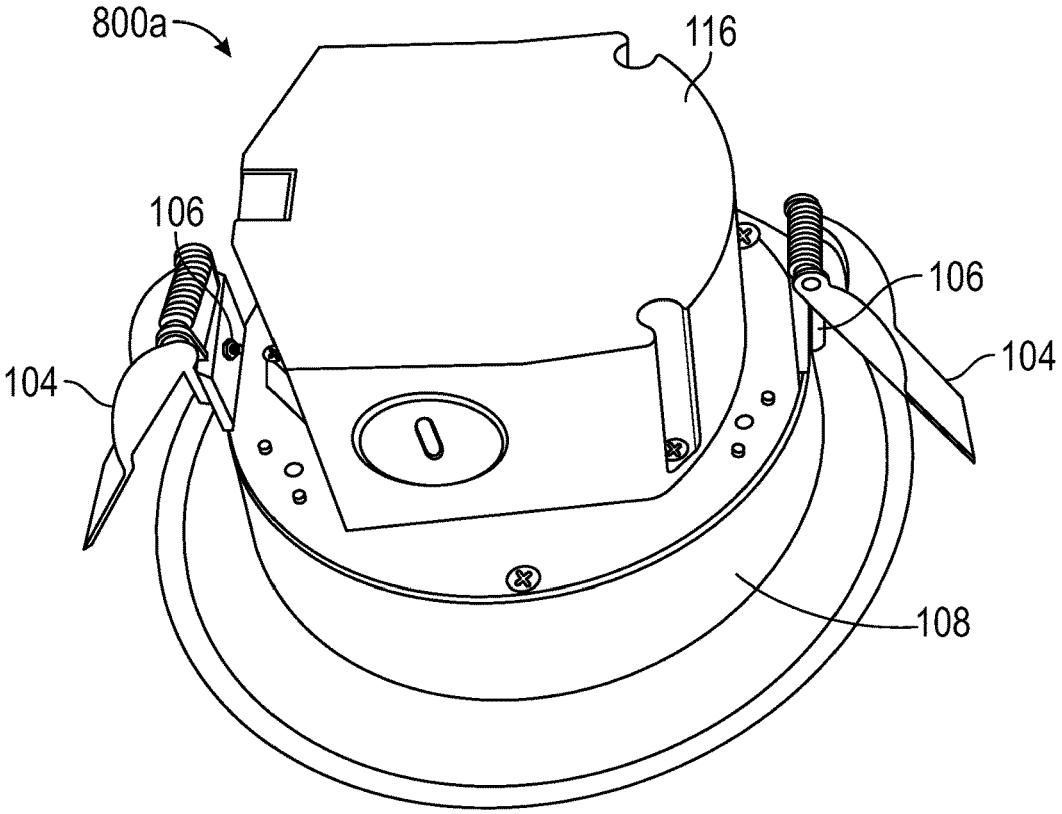
FIG. 8*a* illustrates a first exemplary view of a permanently installed junction box, in accordance with at least one embodiment.
Figure 8B:
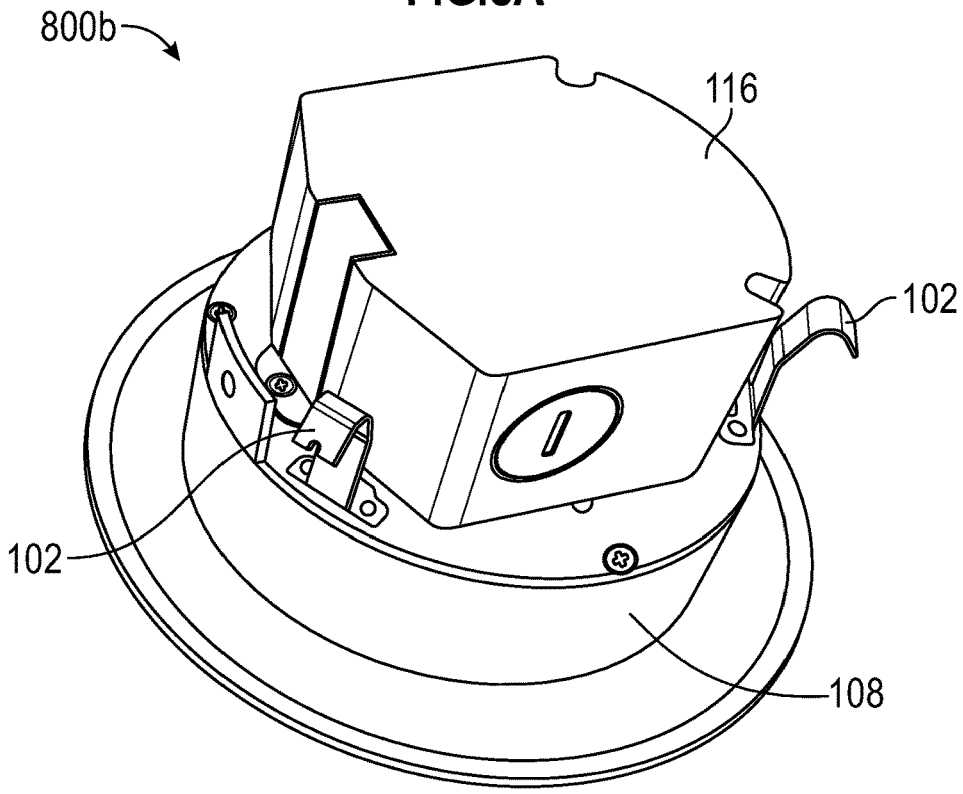
FIG. 8*b* illustrates a second exemplary view of the permanently installed junction box, in accordance with at least one embodiment.

FIG. 8*a* illustrates a first exemplary view (800*a*) of a permanently installed junction box (116), in accordance with at least one embodiment. FIG. 8*b* illustrates a second exemplary view (800*b*) of the permanently installed junction box, in accordance with at least one embodiment. The junction box (116) is permanently attached to the metal housing (108) or plastic housing. The first exemplary view (800*a*) and the second exemplary view (800*b*) show an absence of output wires from the junction box (116) to metal housing (108) or plastic housing. In real-time, the output wire connections are internally arranged and cannot be seen by the user. FIG. 8*a* and FIG. 8*b* also depict the placement of the new construction clip (104), connecting posts (106), and retrofit clips (102) when junction box (116) is permanently attached to the metal housing (108) or the plastic housing.

In an embodiment, the components of the present apparatus such as the plurality of retrofit clips (102), the plurality of new construction clips (104), the metal housing (108), the plurality of screw holes (110), the complete fixture (112), the socket adapter (114), the junction box (116), and the twist connector (118) are reconfigurable and the new construction clips (104) are attached to the connecting posts (106), or to a different connecting method.

In a real-time use, a user such as consumers or electricians has to decide whether the installation of the complete fixture (112) is retrofit or new construction application and then selects an appropriate attachment method.

For a retrofit installation, the user removes the light bulb and trims from the existing recessed lighting fixture and exposes the recessed housing. Then the user removes the two new construction clips (104) from the metal housing (108) or connecting posts (106) and attaches the three retrofit clips (102) by screwing them with provided screws to the die-cast base or metal housing (108) in the provided screw holes (110). The user then attaches the socket adapter (114) by connecting the two free wires to two free wires in the junction box (116). The socket adapter (114) is screwed into an existing socket and places the junction box (116) on top of the metal housing (108) (if the junction box (116) is not attached to metal housing (108) or plastic housing). The user then pushes the complete fixture (112) and the junction box (116) fully into the existing recessed housing, wherein the junction box (116) is attached with the body of the LED light fixture. The complete fixture (112) is held inside existing recessed housing by the friction of retrofit clips (102) against inside the existing recessed housing.

For the new construction installation, the user cuts a hole in the ceiling of the appropriate size to accommodate the metal housing (108), where the complete fixture (112) is to be located. Then the user pulls wires from the building's electrical system and attaches to free wires in a junction box (116). Then the user attaches the junction box (116) to the LED fixture using the twist connector (118). Then the user pushes junction box (116) through a hole in the ceiling and allows it to rest on inside of the ceiling. The user then pushes new construction clips (104) perpendicular to the ceiling and push through the ceiling hole. Then the user allows the new construction clips (104) to squeeze the ceiling between the new construction clips (104) and extremity of the metal housing (108).

Thus the present apparatus provides a means to attach the LED light fixture to the ceiling directly or into a recessed lighting fixture housing. By providing both retrofit and new construction applications, the present apparatus reduces the amount of inventory carried.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms enclosed. On the contrary, the intention is to cover all modifications, alternative constructions, and equivalents falling within the spirit and scope of the invention, as defined in the appended claims. Thus, it is intended that the present invention cover the modifications and variations of this invention, provided they are within the scope of the appended claims and their equivalents.

The invention claimed is:

1. An apparatus to detachably attach an LED light fixture to at least one of a ceiling, and a recessed lighting fixture housing, the apparatus comprises:

a plurality of retrofit clips (102) adaptable to attach with a body of the LED light fixture by screwing them into a plurality of screw holes (110);

a plurality of new construction clips (104);

a plurality of connecting posts (106) to hold the new construction clips (104);

a metal housing (108) to embody a complete fixture (112);

a junction box (116) to hold a plurality of connection wirings, wherein the junction box (116) comprises a plurality of output wires; and a twist connector (118) to attach the output wires of the junction box (116) to the metal housing (108), wherein the retrofit clips (102) make a friction fit inside the recessed lighting fixture housing to secure the complete fixture (112) inside, wherein the new construction clips (104) are attached to the connecting posts (106) if the recessed lighting fixture housing is not present.

2. The apparatus according to claim 1 comprises a socket adapter (114) to replace a light bulb in the recessed lighting fixture housing.

3. The apparatus according to claim 1, wherein the new construction clips (104) squeeze ceiling material placed between the new construction clips (104) and an extremity of the metal housing (108).

4. The apparatus according to claim 1, wherein the complete fixture (112) comprises a plurality of electrical systems, clips, and accessories.

5. The apparatus according to claim 1, wherein the junction box (116) allows an LED driver to be installed and comprises a predefined area to attach a plurality of wires.

* * * * *